US011384615B2

(12) United States Patent
Lybbert

(10) Patent No.: US 11,384,615 B2
(45) Date of Patent: Jul. 12, 2022

(54) CORE RETRIEVING TOOL

(71) Applicant: Lybroco Inc., Edmonton (CA)

(72) Inventor: Devon Lybbert, Edmonton (CA)

(73) Assignee: Lybroco Inc., Edmonton (CA)

( * ) Notice: Subject to any disclaimer, the term of this patent is extended or adjusted under 35 U.S.C. 154(b) by 0 days.

(21) Appl. No.: 17/073,926

(22) Filed: Oct. 19, 2020

(65) Prior Publication Data

US 2022/0120153 A1 Apr. 21, 2022

(51) Int. Cl.
*E21B 25/08* (2006.01)
*E21B 34/10* (2006.01)
*E21B 10/02* (2006.01)

(52) U.S. Cl.
CPC ..... *E21B 25/08* (2013.01); *E21B 10/02* (2013.01); *E21B 34/10* (2013.01); *E21B 2200/05* (2020.05)

(58) Field of Classification Search
CPC ..... E21B 25/08; E21B 34/10; E21B 10/02; E21B 2200/05
See application file for complete search history.

(56) References Cited

U.S. PATENT DOCUMENTS 3,548,958 A * 12/1970 Rumble ..... E21B 25/08 175/233
4,258,803 A 3/1981 Thompson et al.
6,230,825 B1 * 5/2001 Aumann ..... E21B 25/08 175/246
9,441,434 B2 9/2016 Wilson et al.
9,506,307 B2 11/2016 Kinsella

* cited by examiner

*Primary Examiner* — Cathleen R Hutchins
*Assistant Examiner* — Ronald R Runyan
(74) *Attorney, Agent, or Firm* — Finch & Maloney PLLC; Michael J. Bujold; Jay S. Franklin

(57) ABSTRACT

A core retrieving tool for retrieving a core sample of an underground formation includes a coring assembly having a coring bit, a core barrel within a core-receiving chamber, an expandable fluid chamber in fluid communication with the core-receiving chamber, and a valve that selectively seals the core-receiving chamber. The expandable fluid chamber is expandable in response to a pressure differential between the pressure of the core-receiving chamber and an external pressure. With the valve closed, the expandable fluid chamber is in open fluid communication with the core-receiving chamber such that a pressure of the expandable fluid chamber is equalized with the pressure of the core-receiving chamber.

19 Claims, 7 Drawing Sheets

CORE RETRIEVING TOOL

TECHNICAL FIELD

This is related to a retrieving tool for retrieving a core sample from an underground formation, and in particular, a retrieving tool that collects the fluids released by the core sample.

BACKGROUND

Samples of an underground formation are taken from a wellbore using a coring tool. U.S. Pat. No. 9,506,307 (Kinsella) entitled "High pressure coring assembly and method" discloses a coring tool used to obtain core samples from an underground formation.

SUMMARY

According to an aspect, there is provided a core retrieving tool for retrieving a core sample of an underground formation, the core retrieving tool comprising a coring assembly having a coring bit, a core barrel within the coring assembly, the core barrel defining a core-receiving chamber having a first end and a second end, and an expandable fluid chamber in fluid communication with the second end of the core-receiving chamber, and a valve that is moveable between an open position to receive the core sample and a closed position to seal the first end of the core-receiving chamber when the core sample is received within the core barrel, wherein, when the valve seals the first end of the core-receiving chamber, the expandable fluid chamber is expandable in response to a pressure differential between a pressure of the core-receiving chamber and a pressure outside the core barrel, and in a retrieval state, the expandable fluid chamber is in open fluid communication with the core-receiving chamber such that a pressure of the expandable fluid chamber is equalized with the pressure of the core-receiving chamber.

According to other aspects, one or more of the following features may be provided, alone or in combination: the expandable fluid chamber may be in open fluid communication with the core-receiving chamber when the valve is in the open position and in the closed position; the expandable fluid chamber may comprise a piston movable between a first position toward the core receiving chamber and a second position away from the core receiving chamber, wherein the piston moves in response to the pressure differential; expandable fluid chamber may comprise a first portion and a second portion separated from the first portion by the piston, such that, as the piston moves toward the second position, the second portion contracts to allow the first portion to expand and receive fluids from the core-receiving chamber; the second portion may be filled with hydraulic fluid; the retrieving may further comprise a pressure valve that is in fluid communication with the second portion, the pressure valve opening at a preset pressure to expel the hydraulic fluid from the second portion; the coring assembly may comprise an outer housing and an inner housing positioned between the outer housing and the core barrel, wherein the core barrel and the inner housing may define the core-receiving chamber, the inner housing may carry the valve and the core barrel may be moveable within the inner housing; and the core retrieving tool may further comprise a transfer valve in fluid communication with the expandable fluid chamber for selectively removing fluid from the expandable fluid chamber.

According to an aspect, there is provided a method of retrieving a core sample of an underground formation, the method comprising the steps of:

inserting a core retrieving tool in a wellbore, the core retrieving tool comprising a coring assembly comprising a coring bit, a core barrel within the coring assembly, the core barrel defining a core-receiving chamber having a first end and a second end, and an expandable fluid chamber in fluid communication with the second end of the core-receiving chamber, and a valve that selectively seals the first end of the core-receiving chamber;

drilling the core sample with the coring bit;

receiving the core sample into the core-receiving chamber;

closing the valve to seal the first end of the core-receiving chamber; and withdrawing the core-retrieving tool from the wellbore and permitting the expandable fluid chamber to expand in response to a pressure differential between the core-receiving chamber and a pressure outside of the core barrel, the expandable fluid chamber being in open, fluid communication with the core-receiving chamber such that a pressure of the expandable fluid chamber is equalized with the pressure of the core-receiving chamber.

According to other aspects, one or more of the following features may be provided, alone or in combination: the expandable fluid chamber may be in open fluid communication with the core-receiving chamber before and after the valve is closed; permitting the expandable fluid chamber to expand may comprise moving a piston within the expandable fluid chamber from a first position toward the core receiving chamber towards a second position away from the core receiving chamber; the expandable fluid chamber may comprise a first portion and a second portion separated from the first portion by the piston; permitting the expandable chamber to expand may comprise contracting the second portion to allow the first portion to expand and receive fluids from the core-receiving chamber; the second portion may be filled with hydraulic fluid; the method may further comprise the steps of opening a pressure valve that is in fluid communication with the second portion upon reaching a preset pressure and expelling the hydraulic fluid from the second portion; the method may further comprise the step of transferring fluid collected in the core barrel to a surface storage container; the core retrieving tool may further comprise an inner housing between the outer housing and the core barrel, wherein the core barrel and inner housing may define the core-receiving chamber, the inner housing may carry the valve, and the core barrel may be moveable within the inner housing; and the method may further comprise the step of sealing the core sample within the inner housing and removing the inner housing from the outer housing In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

Figure 1:
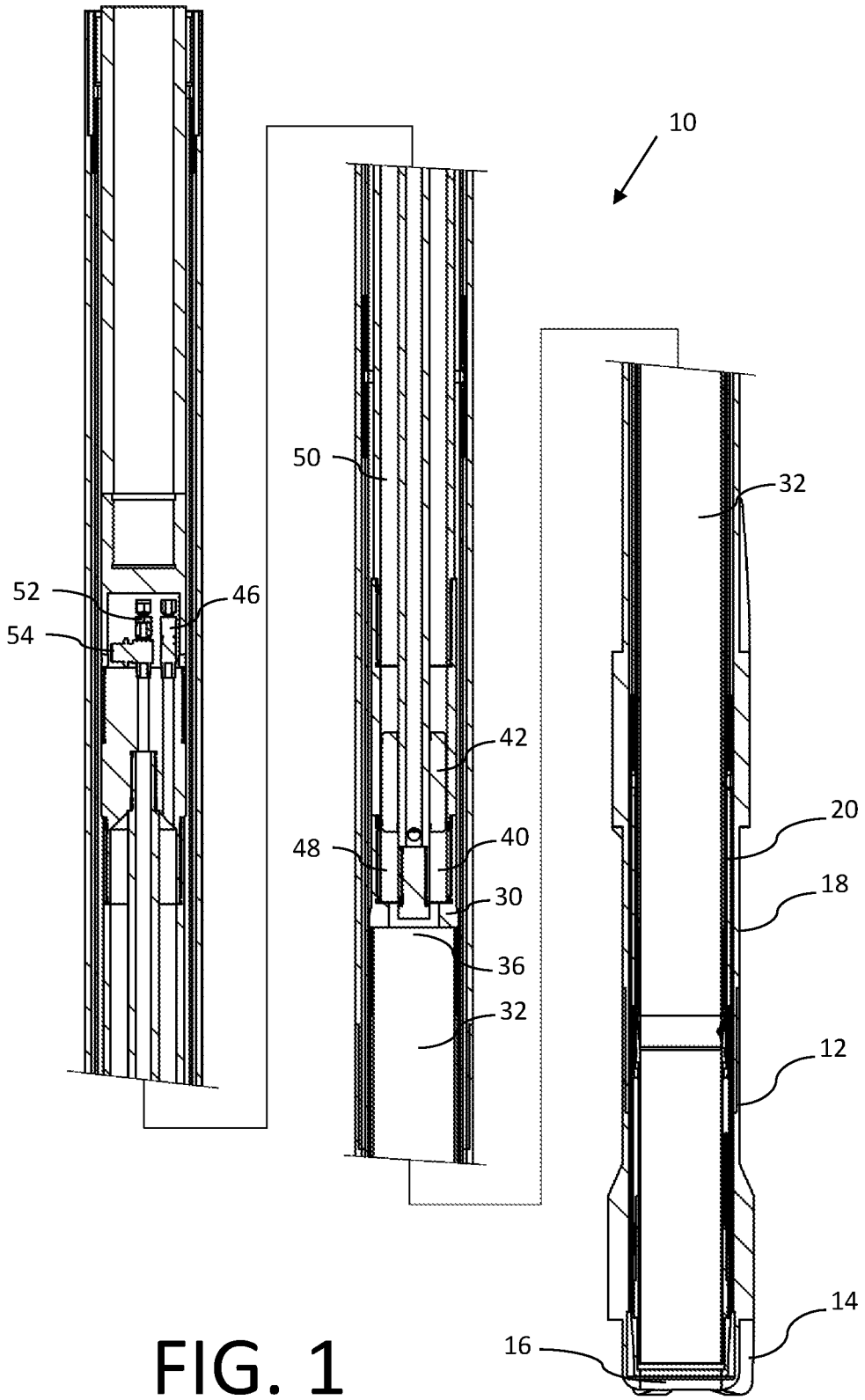
FIG. 1 is a side elevation view in section of a core retrieving tool.

A core retrieving tool, generally identified by reference numeral 10, will now be described with reference to FIG. 1 through 9. Core retrieving tool 10 is designed to be used for obtaining a core sample 100 from an underground formation through a wellbore (not shown). Core samples are obtained from underground formations to help analyse the hydrocarbon content, and will typically contain solids, liquid hydrocarbons, and gaseous hydrocarbons. Core retrieving tool 10 is designed to help obtain core samples from an underground formation by containing the various phases and components present in the core sample after it is drilled until tool is removed from the wellbore, which involves compensating for the change in pressure from the downhole environment and surface while avoiding a dangerous build-up of pressure.

Referring to FIG. 1, a non-limiting example of a core retrieving tool 10 is shown that includes a coring assembly 12 that may be mounted to a wireline or tubing string. Coring assembly 12 has a coring bit 14 at a downhole end 16 that is used to form a core sample 100 from the underground formation. Coring bit 14 may be designed and operated as known in the art to cause the core sample 100 to enter into coring assembly 12.

As shown, coring assembly 12 has an inner housing 20 positioned within an outer housing 18. Coring bit 14 is carried and driven by outer housing 18, while inner housing 20 defines a core-receiving chamber 32 and an expandable fluid chamber 40. Core-receiving chamber 32 has a first end 34 toward the downhole end 16 of coring assembly 12, and a second end 36 that is open to expandable fluid chamber 40.

Figure 2:
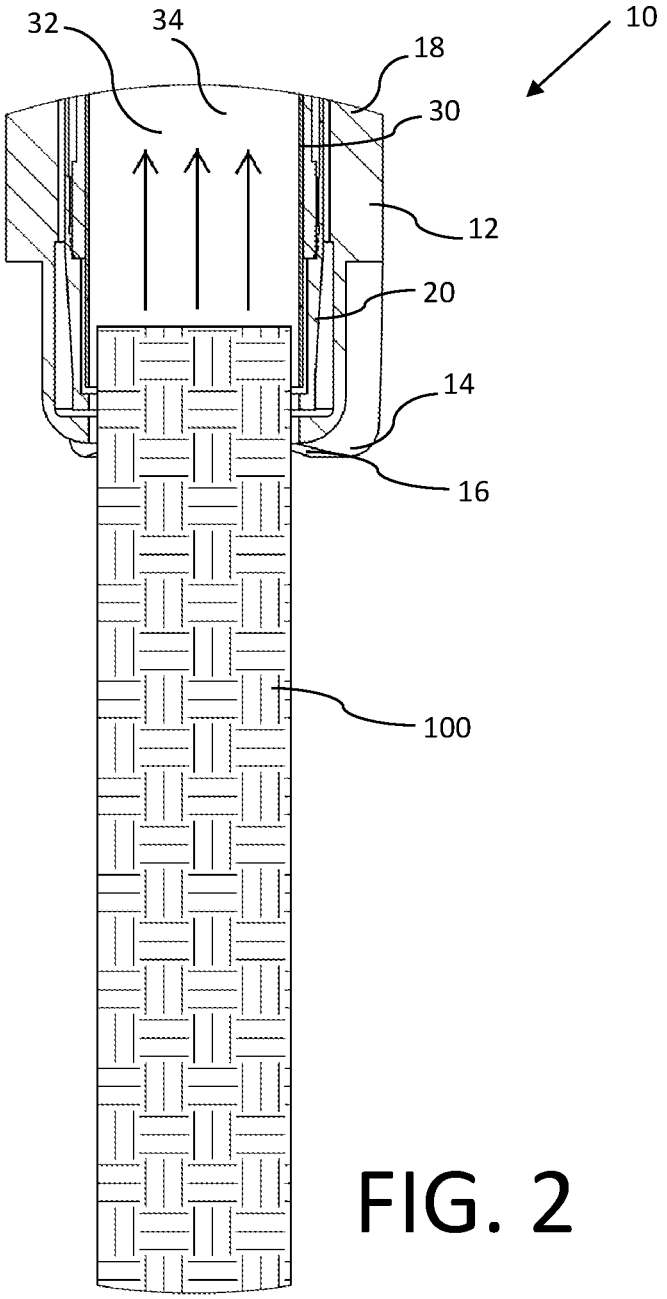
FIG. 2 is a side elevation view in section of a core sample entering the core retrieving tool.
Figure 3:
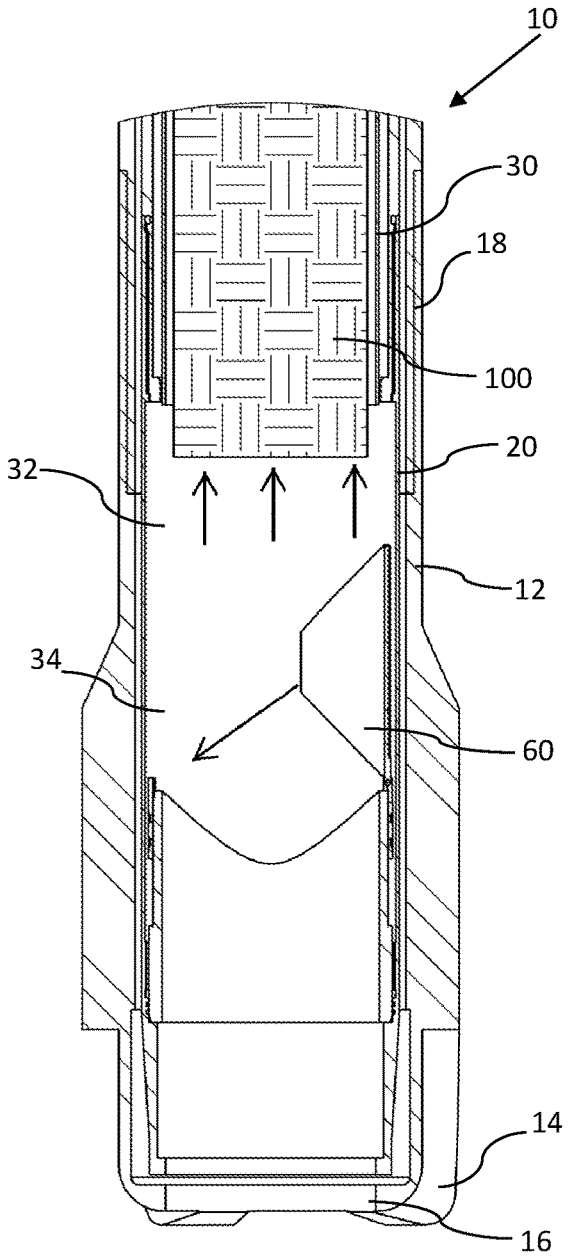
FIG. 3 is a side elevation view in section of a core retrieving tool with an open valve.
Figure 4:
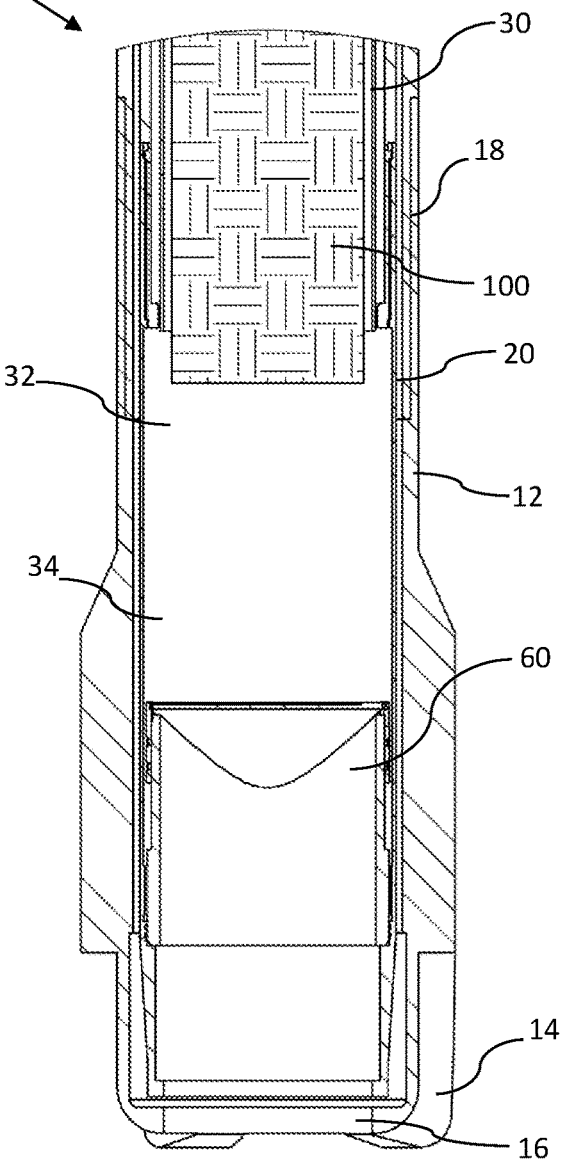
FIG. 4 is a side elevation view in section of a core retrieving tool with a closed valve.

Referring to FIG. 2 through FIG. 4, core-receiving chamber 32 includes a core barrel 30 positioned within inner housing 20 that receives core sample 100 as core sample 100 enters through first end 34. Core barrel 30 may be designed according to known principles to receive and secure core sample 100. Once core sample 100 fully enters core-receiving chamber 32, a valve 60 is used to seal core sample 100 within core-receiving chamber 32.

Valve 60 is shown as a flapper valve, however valve 60 may have any suitable design that, in an open state as shown in FIG. 3, allows core sample 100 to enter core-receiving chamber 32, and in a closed state as shown in FIG. 4, seals core-receiving chamber 32 at first end 34. As a flapper valve design, valve 60 may be designed to improve its ability to seal when closed. For example, valve 60 may have a latch that, when engaged, holds valve 60 in the closed and sealed position, or valve 60 may be designed to use the pressure differential across the flapper to improve the sealing force. Other suitable valve designs may also be used.

In the depicted example, valve 60 is carried by inner housing 20 and core barrel 30 is movable in an axial direction relative to inner housing 20 and outer housing 18. As is known in the art, core barrel 30 may be used to grip core sample 100, which allows core sample 100 to be withdrawn into core-receiving chamber 32, either by raising core barrel 30 or lowering outer and inner housings 18 and 20. Core barrel 30 may be designed according to known processes to allow core sample 100 to be properly manipulated within coring assembly 12. Typically, a core barrel will have a catcher element (not shown) that grips core sample 100 and breaks off core sample 100 from the formation from which it has been drilled. Once properly positioned within core-receiving chamber 32, valve 60 is permitted to close and seal core-receiving chamber 32. This may be done, for example, by releasing a catch that otherwise holds valve 60 open. Valve 60 may be biased to the closed position, such that, when released, it moves to the closed position. Alternatively, valve 60 may be designed to be pushed open as core sample 100 passes by valve 60, which then closes after core sample 100 no longer holds valve 60 open. Those skilled in the art may provide different designs of valve 60, including the manner in which the valve is opened and closed. In the depicted example, core-receiving chamber 32 is defined by core barrel 30 toward second end 36 and inner housing 20 with valve 60 toward first end 34. As will be understood, the design of inner housing 20, core barrel 30, and valve 60 may vary as deemed appropriate by those skilled in the art, provided that the design permits a core sample to be drilled from a formation, and withdrawn into core-receiving chamber 32 sufficiently that it is able to be sealed within chamber 32. As depicted, this is accomplished by permitting core barrel 30 to move relative to inner housing 20 and valve 60, which closes once core sample 100 is withdrawn sufficiently into core-receiving chamber 32.

Figure 5:
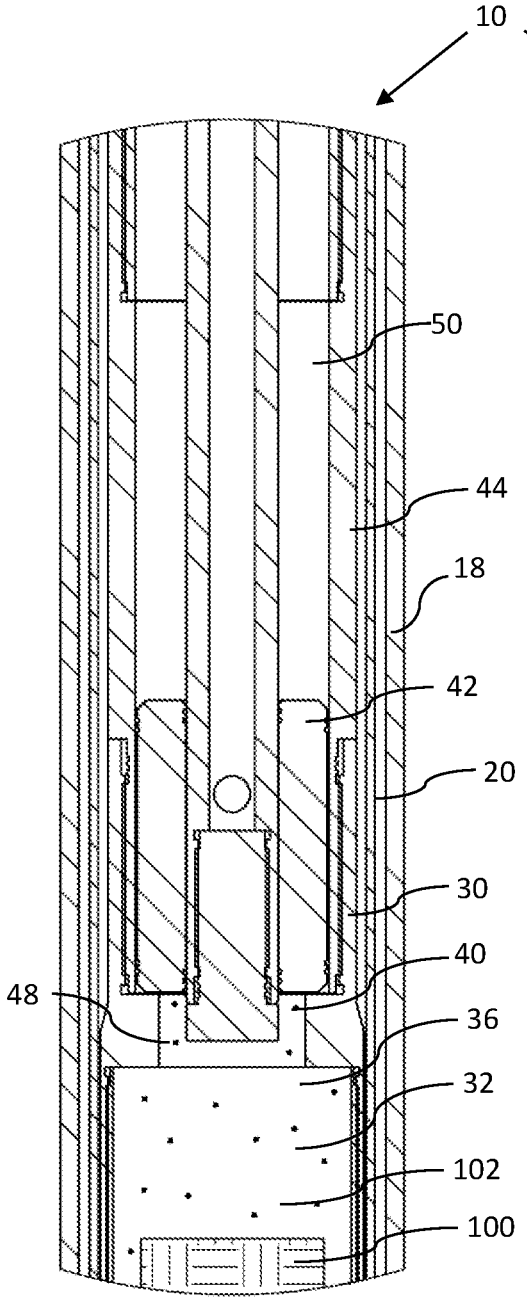
FIG. 5 is a side elevation view in section of a core-receiving chamber and expandable fluid chamber of a core retrieving tool with a piston in a first position.
Figure 6:
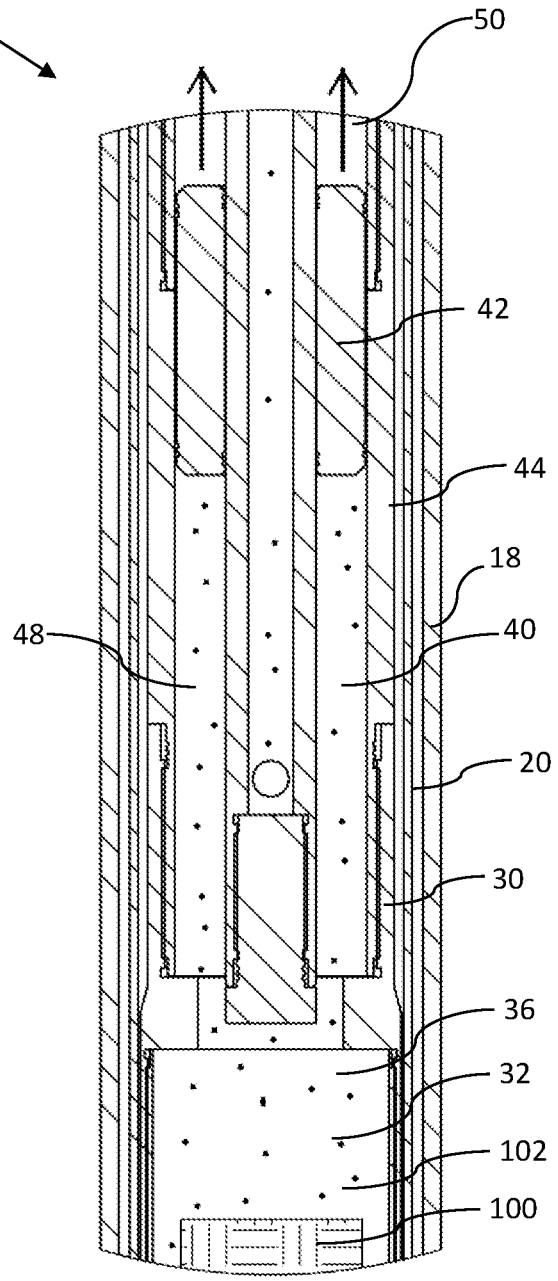
FIG. 6 is a side elevation view in section of the core-receiving chamber of FIG. 5 with the piston moving toward a second position.

Referring to FIG. 5 and FIG. 6, expandable fluid chamber 40 is in fluid communication with core-receiving chamber 32, and, once core-receiving chamber 32 is sealed by valve 60, is designed to expand in response to a pressure differential between the pressure in core-receiving chamber 32 and an external pressure. This will typically be the downhole pressure that is applied to the other side of expandable fluid chamber 40. Tool 10 may also be designed to expose expandable fluid chamber 40 to a different pressure, such as through the use of pressure valves, fluid lines to surface, etc. While this may provide benefits in certain circumstances, doing so would also increase the complexity of the tool.

As shown, expandable fluid chamber 40 is in open fluid communication with core-receiving chamber 32 at all times, i.e. in the core-drilling state, and the retrieval state after the core sample has been formed. However, at the very least, expandable fluid chamber 40 will be in open fluid communication with core-receiving chamber 32 when core sample 100 is sealed within core-receiving chamber 32 and core retrieving tool 10 is in a retrieval state. For example, withdrawing core barrel 30 or closing valve 60 may cause a separate valve or channel to open (not shown). With expandable fluid chamber 40 in open fluid communication with core-receiving chamber 32, the pressure of expandable fluid chamber 40 is equalized with the pressure of core-receiving chamber 32. With valve 60 closed to seal first end 34 of core-receiving chamber 32, fluids 102 including gasses 102 released by core sample 100 will fill core-receiving chamber 32 and expandable fluid chamber 40. As core retrieving tool is returned to surface, the pressure outside of core barrel 30 will be reduced, creating a pressure differential between the pressure in core-receiving chamber 32 and an external pressure. This pressure differential causes expandable fluid chamber 40 to expand, such that gasses 102 and other fluids that have been released or are permitted to be released by the change in pressure from core sample 100 will fill expandable fluid chamber 40 core-receiving chamber 32. This process continues until expandable fluid chamber 40 reaches its largest permitted volume, or until the pressure differential is insufficient to further expand chamber 40.

Figure 7:
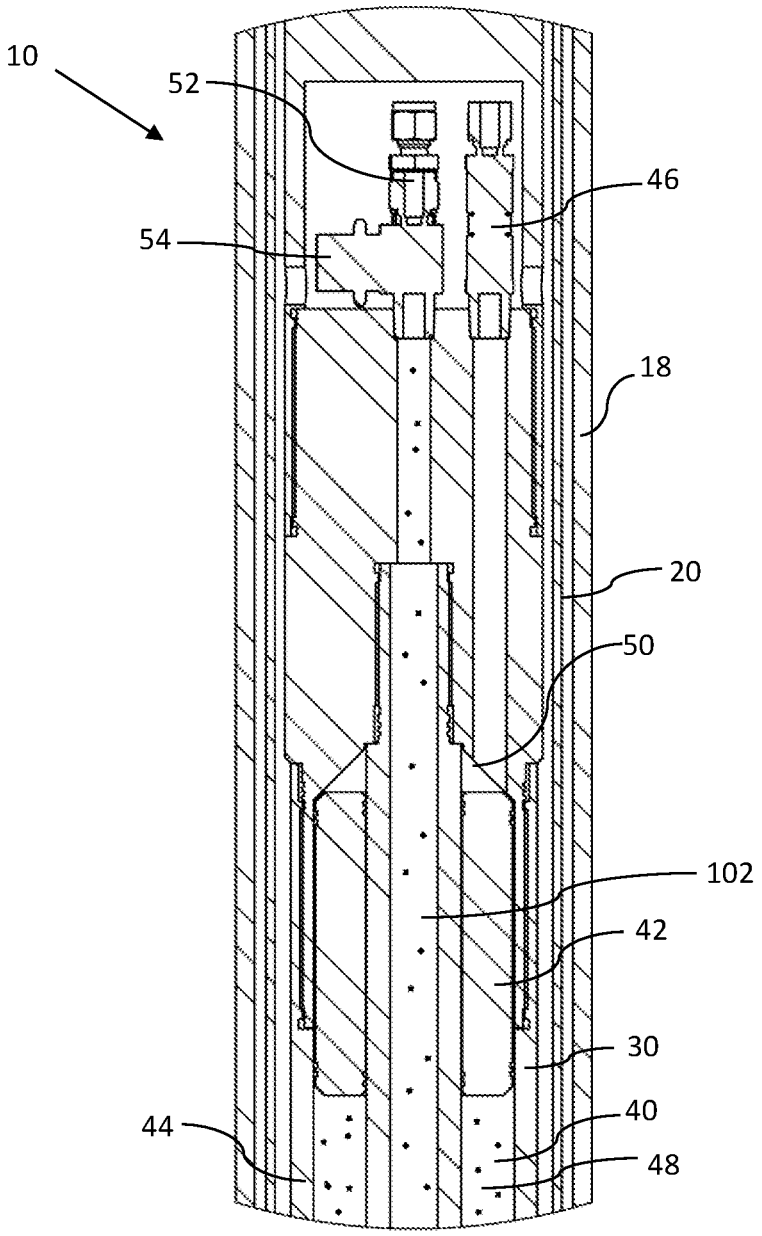
FIG. 7 is a side elevation view in section of the expandable fluid chamber of a core retrieving tool with a piston moving in a second position.

In the depicted example, expandable fluid chamber 40 is designed with a piston 42 within a chamber housing 44 where the piston is movable within chamber housing 44 between a first position toward core receiving chamber 32 and a second position away from core receiving chamber 32, shown in FIG. 5 and FIG. 7, respectively. As piston 42 moves from the first position toward the second position in response to the pressure differential, the volume of expandable fluid chamber 40 increases. Typically, piston 42 remains in the first position when core retrieving tool 10 is in the retrieval state and starts moving after valve 60 seals first end 34 of core-receiving chamber 32 and a pressure differential is applied. In some examples, piston 42 may be biased toward the first position by an initial force that is to be overcome by the pressure differential for expandable fluid chamber 40 to start expanding. This may be, for example, through the presence of a hydraulic fluid on the opposite side of piston 42 that is pushed out in order to allow piston 42 to expand. The hydraulic fluid may be any suitable fluid that allows the tool to operate. Examples may be oil-based or water-based, and may include oil, synthetics oils, vegetable oil, water, saline, or other suitable fluids. The type of fluid selected may be based on the preferences of the user, and the ability of a laboratory to differentiate between the captured fluids and the hydraulic fluids during testing.

As depicted, piston 42 separate chamber housing 44 into a first portion 48 and a second portion 50, where first portion 48 is in fluid communication with core-receiving chamber 32. As piston 42 moves from the first position to the second position, second portion 50 contracts to allow first portion 48 to expand and receive fluids from core-receiving chamber 32. Second portion 50 may be filled with hydraulic fluid that is expelled through a pressure valve 46 in fluid communication with the hydraulic fluid chamber when second portion 50 contracts. Pressure valve 46 may be a check valve that opens once a preset pressure across valve 46 is reached, or it may be a flow restrictor that restricts the rate of flow, such as by appropriate selection of the orifice and/or the viscosity of the hydraulic fluid to provide a desired amount of resistance to movement. If a preset pressure is used, it may fully or partially determine the pressure differential at which expandable fluid chamber 32 expands. Restricting the flow rate through pressure valve 46 may be beneficial as depressurizing a core sample too quickly may damage the integrity of the sample. The hydraulic fluid within second portion 50 will typically be a non-compressible fluid such that the hydraulic fluid cooperates with pressure valve 46 to provide resistance to movement of piston 42. Hydraulic fluid that is expelled through pressure valve 46 may be expelled to an alternate chamber within core retrieving tool 10 or it may be expelled into the wellbore. Other designs that provide an expandable fluid chamber, such as a telescopic chamber where piston 42 is the end of the chamber, may also be used, however having a chamber housing 44 with a fixed length simplifies the use and installation of tool 10.

When piston 42 is in the second position, shown in FIG. 7, expandable fluid chamber 40 has reached its maximum and will not expand further. Core retrieving tool 10 may have an emergency relief valve 52 in fluid communication with the expandable fluid chamber that opens when the pressure reaches a predetermined release pressure. In this way, emergency relief valve 52 may be configured to prevent the pressure differential experienced by core-receiving chamber 32 and expandable fluid chamber 40 from reaching a dangerous level by venting fluid from expandable fluid chamber 40 in order to prevent failure of and/or damage to core retrieving tool 10.

Figure 8:
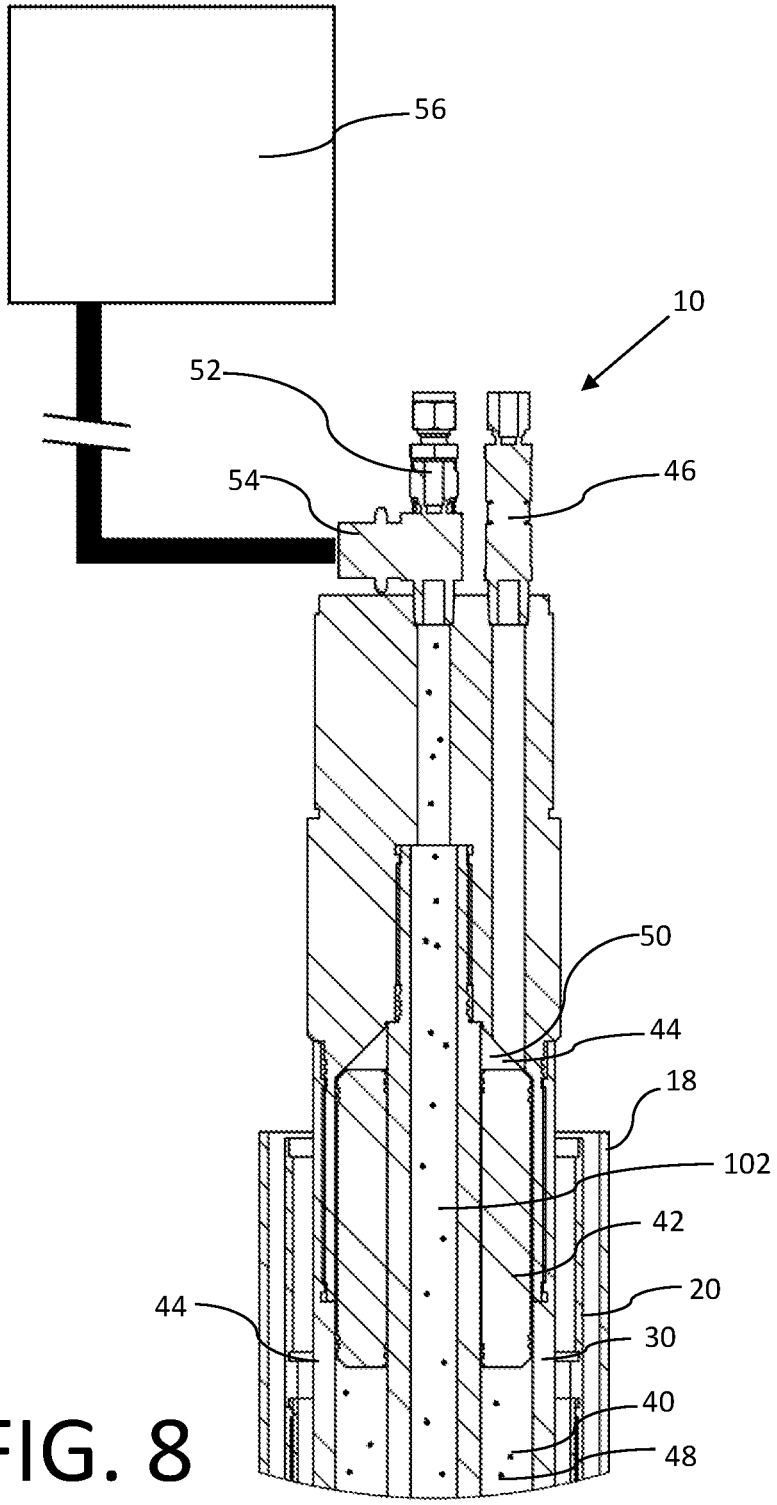
FIG. 8 is an elevated side view in cross section of the expandable fluid chamber of a core retrieving tool connected to a surface storage vessel via a transfer valve.

Referring to FIG. 8, once tool 10 has reached surface, a transfer valve 54 that is in fluid communication with expandable fluid chamber 40 may be used to remove fluid from expandable fluid chamber 40 and transfer them to a separate storage vessel 56. This may be done by equalizing the pressure, by using a fluid pump or compressor to withdraw fluids from expandable fluid chamber 40, or by pumping piston 42 back down to the first position, which will cause fluids to be expelled. Referring to FIG. 8, transfer valve 54 may be used to transfer gasses 102 or other fluids to a surface storage container 56. As depicted, transfer valve 54 is connected to expandable fluid chamber 40 toward second end 36 of core-receiving chamber 32 and piston 42 moves from the second position toward the first position as gasses 102 are transferred to surface storage container 56. Transfer valve 54 may be used to withdraw fluids for further sample, and to reduce the pressure within expandable fluid chamber 40 and core-receiving chamber 32 to atmospheric pressure, or to a non-dangerous pressure level. If the pressure is reduced to a pressure that is at or close to atmospheric pressure, core sample 100 may be removed more easily and safely than if a pressure differential remains, and the majority of downhole fluids released from core sample 100 may be captured.

Figure 9:
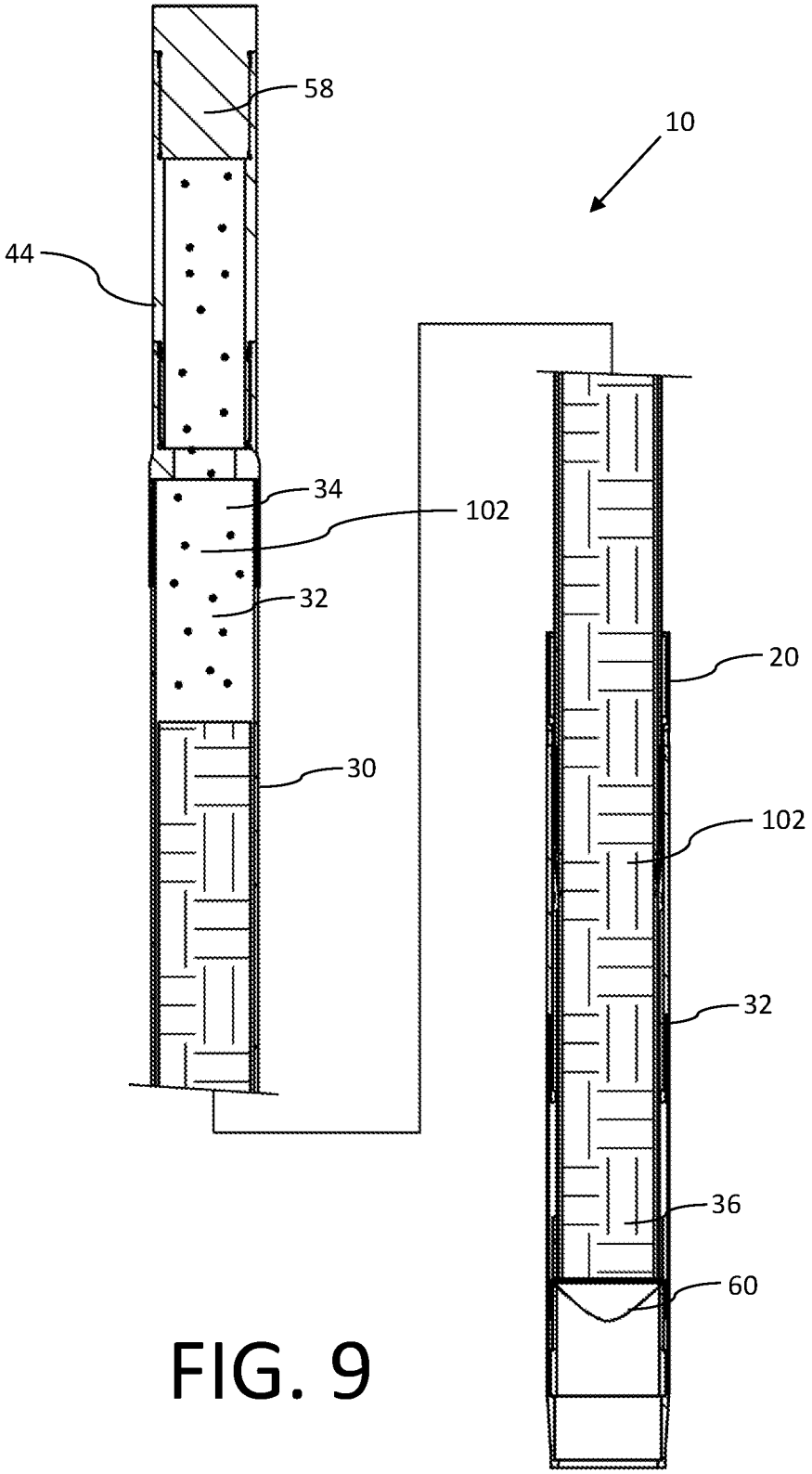
FIG. 9 is an elevated side view in cross section of a core sample sealed within the inner housing of a core retrieving tool.

Referring to FIG. 9, once fluids have been extracted to achieve a safe pressure level within tool 10, core-receiving chamber 32 may be detached from tool 10 and expandable fluid chamber 40, and closed by a plug 58 that seals second end 36 of core-receiving chamber 32. Inner housing 20, sealed by plug 58 and valve 60 and containing core sample 100, may then be transported to a laboratory or other location for further testing and processing. Plug 58 may be installed at any convenient part of core-receiving chamber 32 or expandable fluid chamber 40 in order to properly seal core sample 100 and reduce to an acceptable the loss of any released fluids. Typically, storage container 56 (shown in FIG. 8) that contains the withdrawn fluids will be sent along with the sealed core-receiving chamber 32 for further testing and processing. By providing the core sample as well some or all of the fluids that were released by the core during retrieval, a more accurate and detailed analysis may be provided of the downhole formation.

A method of retrieving core sample 100 using core retrieving tool 10 will now be described with reference to FIG. 1 to FIG. 9.

Referring to FIG. 1, core retrieving tool 10 is assembled and inserted into a wellbore and lowered to an underground formation. Referring to FIG. 2, core sample 100 is drilled using coring bit 14 and core sample 100 is received into core-receiving chamber 32 through first end 34 of core-receiving chamber 32. Once core sample 100 is formed, it may be gripped by core barrel 30 to break core sample 100 and withdraw core sample 100 into core-receiving chamber 32, as shown in FIG. 3. After core sample 100 is in position, valve 60 is closed to seal the first end 34 of core-receiving chamber 32 as shown in FIG. 4.

Once core sample 100 is received within core-receiving chamber 32 and valve 60 is closed, core-retrieving tool 10 is removed from the wellbore back to surface. Referring to FIG. 5-7, as tool 10 is lifted through the wellbore, a pressure differential will develop between core-receiving chamber 32 and an external pressure, such as the wellbore pressure. This pressure differential will cause expandable fluid chamber 40, which is in open fluid communication with core-receiving chamber 32, to expand. As expandable fluid chamber 40 expands, the pressure is equalized between expandable fluid chamber 40 and core-receiving chamber 32, and the pressure differential relative to the external pressure is reduced. This will permit core sample 100 to release some fluids, such as liquids, gasses, and liquids that vaporize under a reduced pressure, and enter expandable fluid chamber 40. Typically, as expandable fluid chamber 40 is above core-receiving chamber 32, the gasses will enter expandable fluid chamber 40 and any liquids that exit core sample 100 will remain in core-receiving chamber 32.

Referring to FIG. 8, after core retrieving tool 10 reaches surface and has been withdrawn from the wellbore, the fluids 102 released by core sample 100 may be removed from expandable fluid chamber 40 and transferred to surface storage container 56. Referring to FIG. 9, second end 36 of core receiving chamber 32 may be sealed by a plug 58 and inner housing 20, still sealed at first end 34 by valve 60 and containing core sample 100, may then be transported for further processing.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A core retrieving tool for retrieving a core sample of an underground formation, the core retrieving tool comprising:
- an outer housing;
- a coring bit connected to a first end of the outer housing;
- a core-receiving chamber having a first end and a second end enclosed by the outer housing;
- a core barrel positioned within the core-receiving chamber that receives the core sample entering the core-receiving chamber;
- an expandable fluid chamber positioned within the outer housing in fluid communication with the second end of the core-receiving chamber, the expandable fluid chamber being expandable in response to a pressure differential between a pressure of the core-receiving chamber and an external pressure;
- an inner housing positioned between the outer housing and the core barrel, the inner housing defining the core-receiving chamber and the expandable fluid chamber, the inner housing being removable from the outer housing; and
- a valve carried by the inner housing, the valve having an open state that permits the core sample to enter the core-receiving chamber, and a closed state that seals the first end of the core-receiving chamber, wherein, with the valve in the closed state, the expandable fluid chamber is in open fluid communication with the core-receiving chamber such that a pressure of the expandable fluid chamber is equalized with the pressure of the core-receiving chamber.

2. The core retrieving tool of claim 1, wherein the expandable fluid chamber is in open fluid communication with the core-receiving chamber when the valve is in the open state and in the closed state.

3. The core retrieving tool of claim 1, the expandable fluid chamber comprising a piston that is movable away from the core receiving chamber in response to the pressure differential.

4. The core retrieving tool of claim 3, wherein the piston separates the expandable fluid chamber into a first volume and a second volume such that, as the piston moves toward an expanded position, the second volume contracts and the first volume expands and receives fluids from the core-receiving chamber.

5. The core retrieving tool of claim 4, wherein the second volume is filled with hydraulic fluid that is expelled as the second volume contracts.

6. The core retrieving tool of claim 5, further comprising a check valve in fluid communication with the second volume that permits the hydraulic fluid to be expelled from the second volume.

7. The coring retrieving tool of claim 1, further comprising a transfer valve in fluid communication with the expandable fluid chamber for selectively removing fluid from the inner housing, the fluid being stored within the expandable fluid chamber.

8. A method of retrieving a core sample of an underground formation, the method comprising the steps of:
- inserting a core retrieving tool in a wellbore, the core retrieving tool comprising an outer housing carrying a coring bit, and a core barrel moveably positioned within a core-receiving chamber within the outer housing, the outer housing further defining an expandable fluid chamber in fluid communication with the core-receiving chamber;
- drilling the core sample with the coring bit and causing the core sample to enter the core-receiving chamber such that the core sample is received by the core barrel;
- sealing the core sample within the core-receiving chamber;
- withdrawing the core retrieving tool from the wellbore and permitting the expandable fluid chamber to expand in response to a pressure differential between a pressure of the core-receiving chamber and an external pressure, the expandable fluid chamber being in open, fluid communication with the core-receiving chamber such that a pressure of the expandable fluid chamber is equalized with the pressure of the core-receiving chamber; and
- transferring fluid from the expandable fluid chamber or the core-receiving chamber to a storage container.

9. The method of claim 8, wherein the expandable fluid chamber is in open fluid communication with the core-receiving chamber before and after a valve seals the core sample within the core-receiving chamber.

10. The method of claim 9, wherein permitting the expandable fluid chamber to expand comprises moving a piston within the expandable fluid chamber from a first position toward the core receiving chamber towards a second position away from the core receiving chamber.

11. The method of claim 10, wherein the expandable fluid chamber comprises the piston that moves to expand a first volume in response to the pressure differential to receive fluids from the core-receiving chamber and contract a second volume.

12. The method of claim 11, wherein second volume is filled with hydraulic fluid that is expelled through a check valve as the second volume contracts.

13. The method of claim 8, wherein the core retrieving tool further comprises an inner housing between the outer housing and the core barrel, wherein the inner housing defines the core-receiving chamber and the expandable fluid chamber, the inner housing carries a valve, and the core barrel is moveable within the inner housing.

14. The method of claim 13, further comprising the step of removing the inner housing from the outer housing within the core sample within the inner housing.

15. A core retrieving tool for retrieving a core sample of an underground formation, the core retrieving tool comprising:

an outer housing;

a coring bit connected to a first end of the outer housing;

a core-receiving chamber having a first end and a second end enclosed by the outer housing;

a core barrel positioned within the core-receiving chamber that receives the core sample entering the core-receiving chamber;

an expandable fluid chamber positioned within the outer housing in fluid communication with the second end of the core-receiving chamber, the expandable fluid chamber being expandable in response to a pressure differential between a pressure of the core-receiving chamber and an external pressure;

a piston that separates the expandable fluid chamber into a first volume and a second volume filled with hydraulic fluid;

a check valve in fluid communication with the second volume that permits the hydraulic fluid to be expelled from the second volume such that, as the piston moves toward an expanded position, the first volume expands and receives fluids from the core-receiving chamber and the second volume contracts and expels hydraulic fluid via the check valve; and a valve having an open state that permits the core sample to enter the core-receiving chamber, and a closed state that seals the first end of the core-receiving chamber, wherein, with the valve in the closed state, the expandable fluid chamber is in open fluid communication with the core-receiving chamber such that a pressure of the expandable fluid chamber is equalized with the pressure of the core-receiving chamber.

16. The core retrieving tool of claim 15, further comprising an inner housing positioned between the outer housing and the core barrel, the inner housing defining the core-receiving chamber and the expandable fluid chamber, the inner housing being removable from the outer housing, the inner housing carrying the valve.

17. The core retrieving tool of claim 15, wherein the expandable fluid chamber is in open fluid communication with the core-receiving chamber when the valve is in the open state and in the closed state.

18. The core retrieving tool of claim 15, the expandable fluid chamber comprising a piston that is movable away from the core receiving chamber in response to the pressure differential.

19. The coring retrieving tool of claim 15, further comprising a transfer valve in fluid communication with the expandable fluid chamber for selectively removing fluid from the inner housing, the fluid being stored within the expandable fluid chamber.

* * * * *